United States Patent [19]

Schneier et al.

[11] 4,262,447

[45] Apr. 21, 1981

[54] DOUBLE ACTING HINGED PRESSURE VESSEL CLOSURE

[75] Inventors: Michael L. Schneier, Pittsford; Henry B. Peters, Webster, both of N.Y.

[73] Assignee: Sybron Corporation, Rochester, N.Y.

[21] Appl. No.: 67,608

[22] Filed: Aug. 20, 1979

[51] Int. Cl.[3] ..... E05D 15/58

[52] U.S. Cl. ..... 49/254; 49/395; 220/331; 422/118; 422/295

[58] Field of Search ..... 49/254, 255, 258, 259, 49/156, 394, 395; 422/118, 295, 242; 220/331

[56] References Cited

U.S. PATENT DOCUMENTS

| | | | |
|---|---|---|---|
| 2,685,983 | 8/1954 | Kelley | 220/331 X |
| 3,768,203 | 10/1973 | Bellucci | 49/254 |
| 3,788,689 | 1/1974 | Lloyd | 49/254 X |
| 4,048,050 | 9/1977 | Hillman | 220/331 X |

FOREIGN PATENT DOCUMENTS

| | | | |
|---|---|---|---|
| 1193854 | 6/1970 | United Kingdom | 220/331 |

*Primary Examiner*—Philip C. Kannan

*Attorney, Agent, or Firm*—Theodore B. Roessel; Roger Aceto

[57] ABSTRACT

A closure for a sterilizer or other pressure vessel, the door having a compound motion to permit swinging movement on hinges and lateral sliding movement with respect to the hinges.

7 Claims, 8 Drawing Figures

DOUBLE ACTING HINGED PRESSURE VESSEL CLOSURE

BACKGROUND OF THE INVENTION

The present invention relates to pressure vessels, such as steam sterilizers and the like. More particularly the present invention relates to an improved closure for such a pressure vessel wherein the closure or door is capable of a compound motion to facilitate movement of even a relatively large door between a open and closed position within a restricted area.

Generally the door of a steam sterilizer or the like is either of two types. The first type is a hinged or swinging door. One such door for a relatively large steam sterilizer or autoclave is illustrated in U.S. Pat. No. 3,397,489. A swinging or hinged door has the advantage that it opens into the room containing the sterilizer so that the door can be opened in a relatively restricted area. Swinging doors, however, usually require a relatively extensive mechanical clamping means for holding the door in a closed position as the sterilizing vessel is pressurized.

The second type of door commonly used is a sliding door. U.S. Pat. Nos. 3,488,142 and 3,694,962 illustrate sliding doors used in relatively large sterilizers and autoclaves. Sliding doors have the advantage that a relatively simple mechanical clamp may be used to hold the door against internal pressures. The disadvantages of such a door is that a relatively large area to the side, above or below the sterilizing vessel must be provided to receive the sliding door as it moves to an open position. Thus, while sliding doors may be preferred because of the simplicity of construction, this advantage is often offset by the relatively large area need to accommodate operation of the door.

In the present invention, the door supporting structure allows a compound motion of the door which combines the advantages of both the swinging and sliding doors. In this respect, the door is hinged for swinging movement so that it can be opened in a relatively restricted area, yet the door is capable of a limited sliding motion to take advantage of the relatively simple mechanical means used to hold the door in closed position against internal sterilizer pressures.

SUMMARY OF THE INVENTION

The present invention may be characterized in one aspect thereof by hinges which are fixed to the vessel for swinging movement about a vertical axis and means supporting the sterilizer door on the hinges for sliding lateral movement of the door with respect to the hinges. A handle connected between the door member and the vessel body provides a mechanical advantage for moving the door laterally with respect to the hinges between a first open position and a second closed position. Conventional means between the periphery of the door and the vessel body cooperate and engage upon lateral movement of the door to the closed position for holding the door fast against internal sterilizer pressures.

DESCRIPTION OF THE PREFERRED EMBODIMENTS

Figure 1:
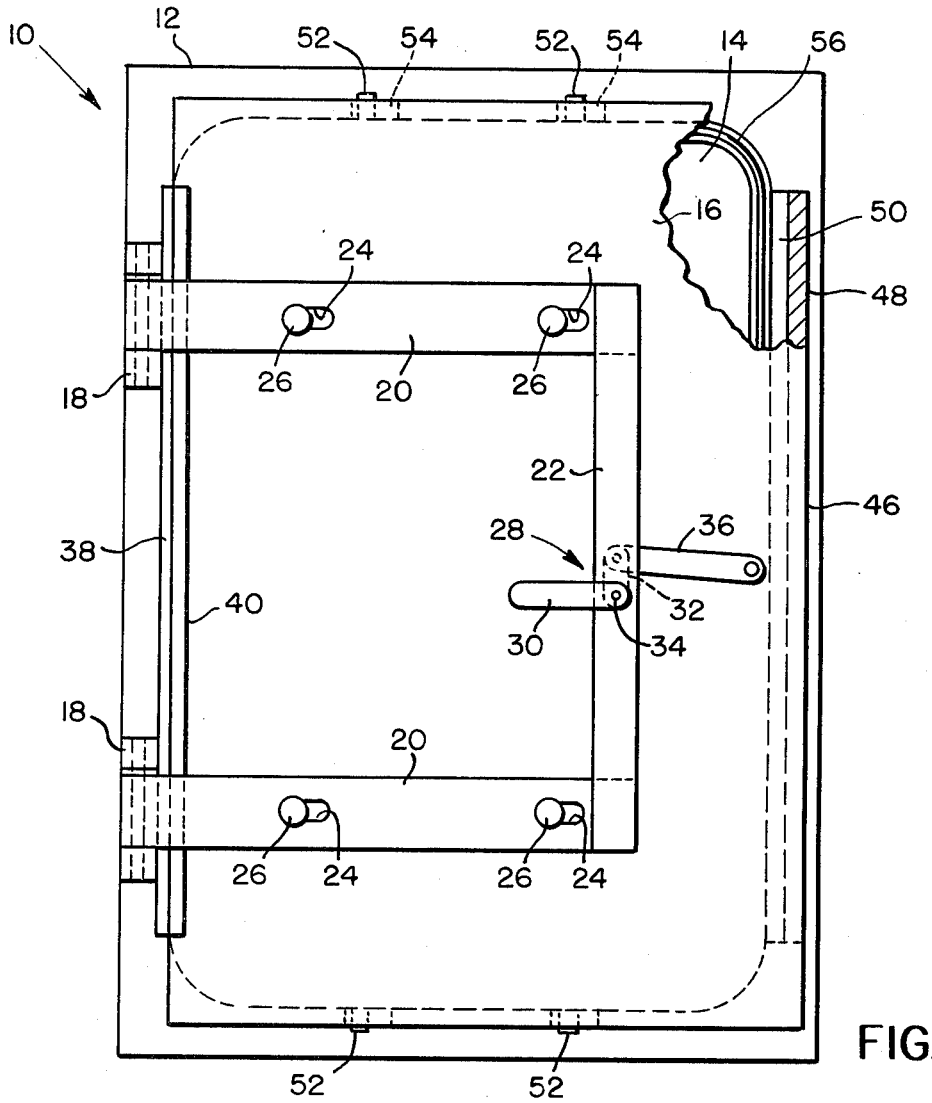
FIG. 1 is a front elevation view of a sterilizer having the door supporting structure of the present invention.

Referring to the drawings, FIG. 1 shows a sterilizer generally indicated at 10 including the door and supporting structure of the present invention. The sterilizer includes a sterilizer body 12 having an opening 14 and a door 16 for closing the sterilizer opening. It should be appreciated that sterilizing vessels of this type may range in size up to a walk-in unit where the goods to be sterilized are loaded by fork lift or are put on push carts and the carts rolled into the sterilizer through opening 14.

Attached to sterilizer body 12 adjacent one side of opening 14 are a pair of hinges 18 which are oriented for swinging movement about a vertical axis. Extending from each hinge 18 and across sterilizer door 16 is a support arm 20. A brace 22 extends between and connects the ends of arms 20.

Each support arm 20 is provided with a pair of elongated openings 24. These openings slidably receive pins 26 which are attached to the sterilizer door. Pins 26 are captured in openings 24 for mounting and supporting the door on support arms 20.

Since the sterilizer door is mounted on support arms 20, the door can swing away from the sterilizer opening 14 on hinges 18. In addition, since pins 26 can slide from one end of openings 24 to the other, the door does have a limited range of lateral movement with respect support arms 20 and hinges 18. This permits limited operation of the door similar to a conventional sliding door as shown for example in U.S. Pat. No. 3,488,142.

Manual operation of sliding the door is accomplished with a generally L-shaped lever 28 having a long lever arm 30 and a short lever arm 32 with the fulcrum being at 34 where the lever is journaled to brace 22.

The long lever arm 30 is a handle and the short lever arm 32 is pivotally connected to one end of a link 36. The other end of link 36 is pivotally connected to door 16.

Thus, when handle 30 is rotated clockwise as viewed in FIG. 1, the force is multiplied by short lever arm 32 so as to facilitate sliding the door to the right. Conversely, counterclockwise rotation of the handle will slide the door to the left.

By operating as a sliding door, conventional means can be used to lock the door against internal sterilizer pressures. In this respect, a generally L-shaped flange 38 is fixed to the sterilizer body on the hinge side of opening 14.

Figure 2:
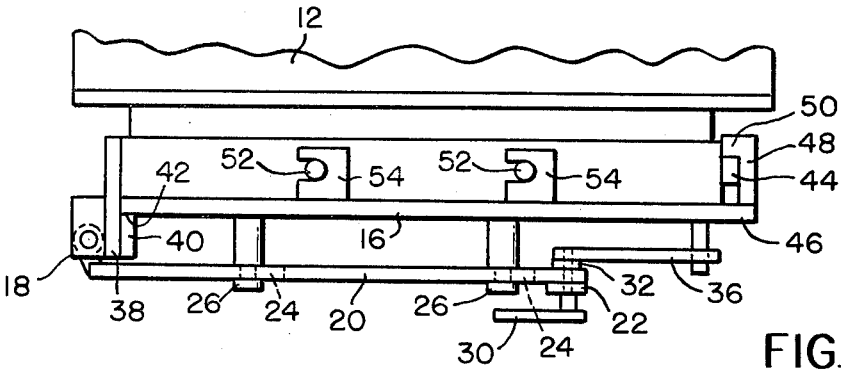
FIG. 2 is a plan view showing the sterilizer door in a full closed position.
Figure 3:
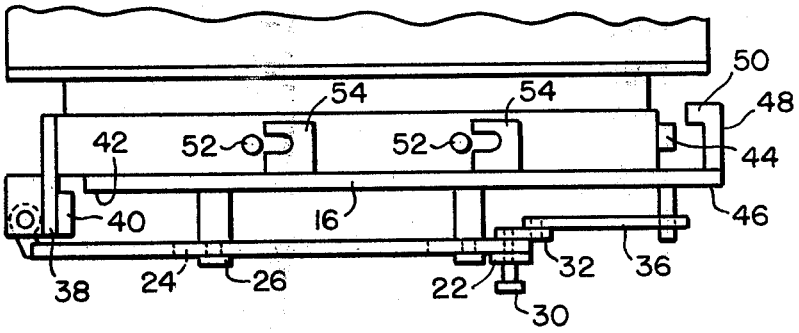
FIG. 3 is a view similar to FIG. 2 showing the door against the sterilizer but in a partly closed position.
Figure 4:
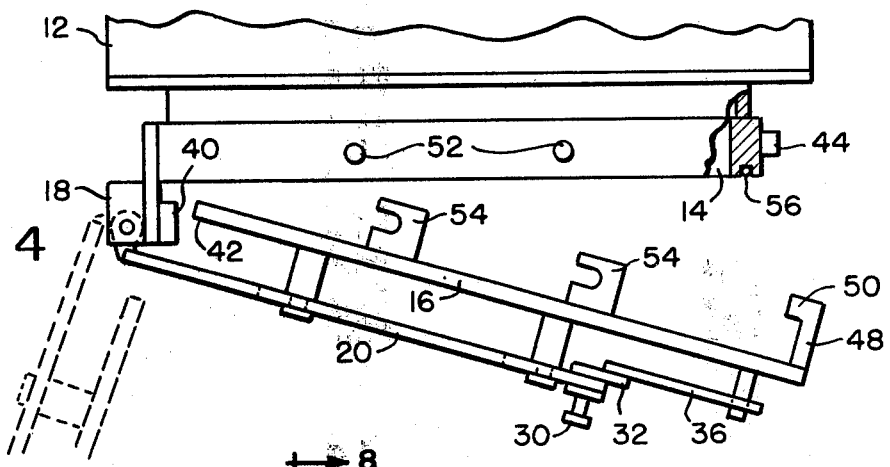
FIG. 4 shows the door structure swung away from the sterilizer.

As best seen in FIGS. 2–4, flange 38 has a portion 40 which is spaced outwardly from the plane of sterilizer opening 14 by an amount substantially equal to the thickness of the adjacent peripheral edge 42 of sterilizer door 16. With this arrangement, flange portion 40 will completely overlie peripheral door edge 42 when the door is in the closed position (FIG. 2).

On the opposite side of vessel opening 14 from hinges 18 there is a rib member 44 that is fixed to the vessel body 12 adjacent the plane of opening 14 (FIGS. 2–4). Running along the peripheral edge 46 of the door, opposite peripheral edge 42 is an L-shaped flange 48. This flange 48 has a portion 50 spaced from the plane of the door and adapted to overlie rib 44 on the sterilizer body when the door is in the closed position as shown, for example, in FIG. 2.

The top and bottom edges of the sterilizer body are provided with a plurality of spaced pins 52 which are set back slightly from the plane of the sterilizer opening 14. When the door is in a closed position as shown in FIG. 2, these pins are captured in nests 54 at the top and bottom edges of the sterilizer door.

For purposes of describing the operation of the door, it should be assumed that the door is in the full position as shown in dotted line in FIG. 4. After goods have been loaded in the sterilizing chamber through opening 14, the door is simply swung on its hinges 18 until it is moved against the sterilizer body to the partly closed position as shown in FIG. 3. Handle 30 is then rotated counterclockwise as viewed in FIG. 1, to slide the door with respect to hinge members to the left as viewed in the figures. Sliding door 16 to the left causes the peripheral edge 42 of the door to slide under sterilizer flange portion 40. Likewise, the flange portion 50 on the sterilizer door will slide over rib 44 on the sterilizer body while nests 54 at the top and bottom of the door will engage pins 52 on the sterilizer. This locks the door 16 to the sterilizer body. Thereafter, a moveable seal 56 (FIGS. 1 and 4) which forms no part of the present invention is activated to effect a seal between the sterilizer body and the door. The structure and operation of seal member 56 is set out in detail in assignee's U.S. Pat. No. 3,694,962.

To open the vessel door, the handle 30 is simply rotated clockwise to slide the door to the right as viewed in figures and thereafter the door may be swung on its hinges to the full open position.

Thus the door as described combines the advantages of both a swinging door and a sliding door without the inherent disadvantages of either. Hinging the door for swinging operation permits opening in a relatively restricted area as opposed to pull slide opening door. The limited sliding action however, is sufficient to take advantage of the relatively simple locking mechanism of a sliding door as opposed to that of a hinged door.

Figure 5:
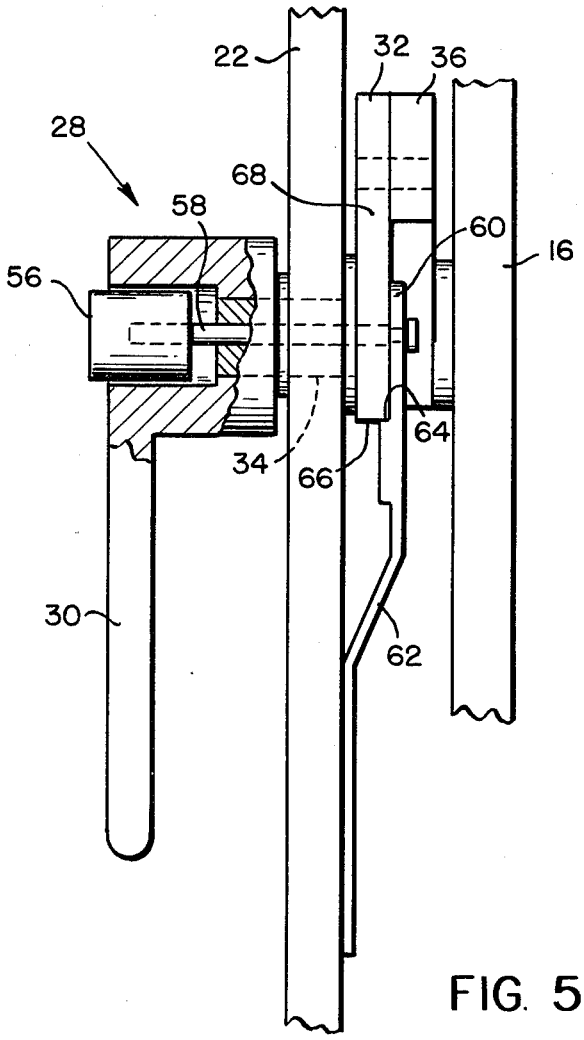
FIG. 5 is an enlarged view, partly broken away and in section showing the handle structure of the door.

FIG. 5 shows, in greater detail, the construction of the operating lever 28, including handle 30, short lever arm 32, journal or fulcrum 34, link 36 and the attachment of these parts between brace 22 and door 16.

As shown in FIG. 5, handle 30 has a push button 56 which is attached to one end of a rod 58 extending through the journal or fulcrum 34. The other end of rod 58 in turn is attached to the free end 60 of a cantilevered flat spring 62 fixed to the reverse side of brace 22 from handle 30.

The free end 60 of the spring has a shoulder 64 which acts as a catch or stop engaging one of the sides 66 or 68 of the short lever arm 32 to prevent the movement of this arm. With the door in the closed position (FIG. 2), the stop or catch provides a lock to prevent accidental opening of the door, but when the door is being swung open, the catch stabilizes the door by preventing it from sliding back and forth on support arms 20.

To operate the handle 30 for sliding the door, push button 56 is pushed so as to move rod 58 and the free end 60 of spring 62 to the right as viewed in FIG. 5. This disengages the shoulder 64 from the side 66 short lever arm 32 so that the handle and therefore lever arm 32 can be turned 90° for sliding the door to the left as viewed in the figures. Thereafter, the shoulder 64 will catch against the other side 68 of the short lever arm to lock it in position until the push button is depressed again.

Figure 6:
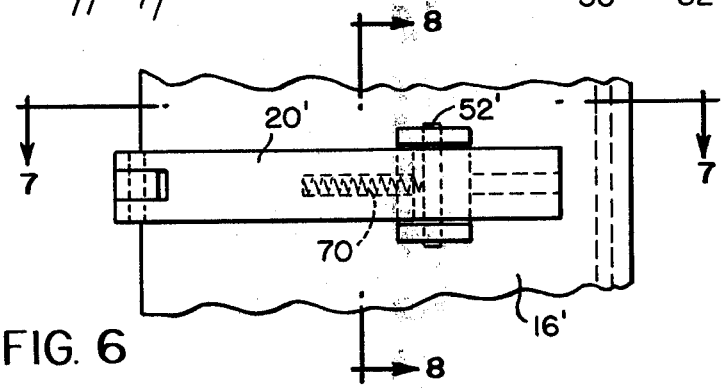
FIG. 6 is a front elevation view showing another embodiment of the door hinge with the door in the full closed position.
Figure 8:
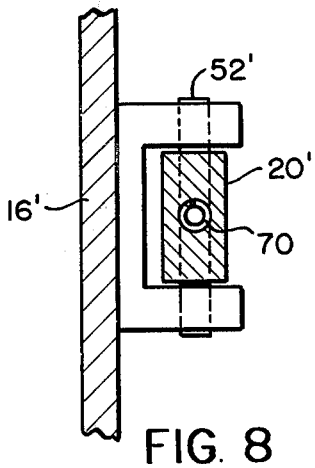
FIG. 8 is a view taken along lines 8—8 of FIG. 6.
Figure 7:
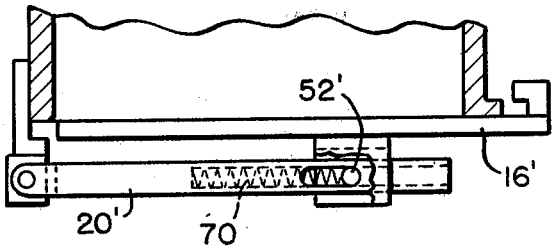
FIG. 7 is taken along lines 7—7 of FIG. 6 only showing the door in a partly closed position.

FIGS. 6–8 show another embodiment for preventing the door from sliding side to side as it swings open. Here, support arms 20′ each carry a coil spring 70 for urging pins 52′ and therefore door 16′ to the left or unlocked position as shown in FIG. 6. In this manner the door is kept from sliding as it swings open. Operation of the handle (not shown) for moving the door to a latched position (to the right) compresses these coil springs so that suitable means (not shown) must be provided for locking the handle when the door is in the latched position.

Thus, it should be appreciated that the present invention does provide a simple, easily operated door having a compound motion so as to combine the advantage of both swinging and sliding doors.

We claim:

1. A closure for the load opening of a sterilizer or like pressure vessel comprising:
   (a) hinge members fixed to said vessel adjacent said opening for swinging movement about a vertical axis;
   (b) a door member for said opening;
   (c) means for slidably supporting said door member of said hinge members including a pin carried by one of said members and extending through an elongated slot formed in the other of said members;
   (d) mechanical advantage means operatively connected between said door member and vessel for sliding said door with respect to said hinge members between a first and a second position; and
   (e) flanges on said door member and vessel cooperating for engagement upon sliding movement of said door member to said second position.

2. A closure as set out in claim 1 wherein said hinge members include support arms extending horizontally across said door member, said pins being on said door member and said slots being formed in said support arms.

3. A closure as in claim 2 including a vertically extending brace connecting said support arms, said mechanical advantage means being operatively connected between said brace and door member.

4. A closure as in claim 3 wherein said mechanical advantage means comprises:
   (a) a generally L-shaped lever journaled to said brace, said lever having a long leg and a short lever arm wherein said long leg is a handle; and
   (b) a link pivotally connected at its ends to said door member and said short lever arm respectfully, the rotation of said handle operating through said short lever arm and link to slide said door member between said first and second positions.

5. A closure as in claim 4 including a movable stop adapted to engage and hold said handle against rotation.

6. A closure as in claim 5 wherein said stop comprises:
   (a) a cantilevered leaf spring fixed to said brace, the free end of said leaf spring being formed with a shoulder adapted to engage one side or another of said short lever arm;

(b) a push button on said handle and extending through said journal and against the free end of said leaf spring for moving said free end and therefore said shoulder out of engagement with said short lever arm.

7. A closure as in claim 1 wherein said support means comprises:

(a) a support arm extending from said hinge and across said door member, said support arm having an opening therethrough which is elongated in the direction of the sliding movement of said door;

(b) a pin fixed to said door member and extending slidably through said elongated opening, the limits of sliding movement of said door being defined by the sliding movement of said pin from one end of said elongated opening to another; and (c) bias means between said pin and support arm for normally urging said door to one limit of its sliding movement.

* * * * *